United States Patent [19]

Smart et al.

[11] 4,129,966

[45] Dec. 19, 1978

[54] GRINDER APPARATUS WITH POLLUTION CONTROL FLUID DISPENSING MEANS

[75] Inventors: William L. Smart, Indianapolis, Ind.; Stuart A. Hoenig, Tucson, Ariz.; Christian W. Savitz, Tucson, Ariz.; Douglas K. Darlington, Tucson, Ariz.

[73] Assignee: Ransburg Corporation, Indianapolis, Ind.

[21] Appl. No.: 827,459

[22] Filed: Aug. 25, 1977

[51] Int. Cl.[2] ..... B24B 23/02; B24B 55/02

[52] U.S. Cl. ..... 51/170 T; 51/134.5 F; 51/267

[58] Field of Search ..... 51/267, 134.5 F, 266, 51/170 T, 170 AT

[56] References Cited

U.S. PATENT DOCUMENTS

| | | | |
|---|---|---|---|
| 1,698,970 | 1/1929 | Shaff | 51/267 |
| 1,715,574 | 6/1929 | Skriba | 51/267 |
| 1,971,790 | 8/1934 | Mall | 51/267 |
| 2,207,312 | 7/1940 | Consigliere | 51/134.5 F |
| 2,626,493 | 1/1953 | Speicher | 51/267 |
| 2,733,562 | 2/1956 | Drummond | 51/267 |
| 3,099,905 | 8/1963 | Rebechini | 51/263 |

FOREIGN PATENT DOCUMENTS

| | | | |
|---|---|---|---|
| 1436072 | 5/1976 | United Kingdom | 51/267 |

OTHER PUBLICATIONS

Western Electric Technical Digest No. 37, Jan. 1975, p. 9, Temperature Controlled Spray Mist Application in Machining Operations, Fitzsimmons et al.

*Primary Examiner*—Harold D. Whitehead

*Assistant Examiner*—Roscoe V. Parker

*Attorney, Agent, or Firm*—Merrill N. Johnson; Richard D. Conard

[57] ABSTRACT

A hand-held grinder including a motor, a motor output shaft and a grinding tool mounted on the motor output shaft. Water is supplied from a source through a port into a sealed annular chamber surrounding the output shaft. A bore extends concentrically through the shaft between a point adjacent the annular chamber and the end of the shaft remote from the motor. Communicating bores extend radially through the shaft and through a collar keyed to the shaft from the concentric bore to the annular chamber. Additional bores, adjacent the end of the shaft remote from the motor, provide communications between the concentric bore and the outside of the shaft. Preferably, the sum of the cross-sectional areas of these last-mentioned bores is relatively less than the cross-sectional area of the concentric bore. Water dispensed through these communicating bores is atomized by rotation of the motor output shaft and grinding tool. The atomized water particles are directed toward the work piece upon which the grinding operations are being performed to capture respirable micron and submicron sized particulate contaminants generated by such grinding operations. In other embodiments of the invention, nozzles are provided to atomize the water. The nozzles are located adjacent the grinding tool. Desirably, the nozzles are flexibly mounted so that they can be aimed at the region of the grinding tool at which the particulate contaminants are being generated. In one of the atomizing nozzle embodiments, the motor is an air motor and exhaust air from the motor is used to atomize the water in the nozzle.

5 Claims, 4 Drawing Figures

Figure 2:
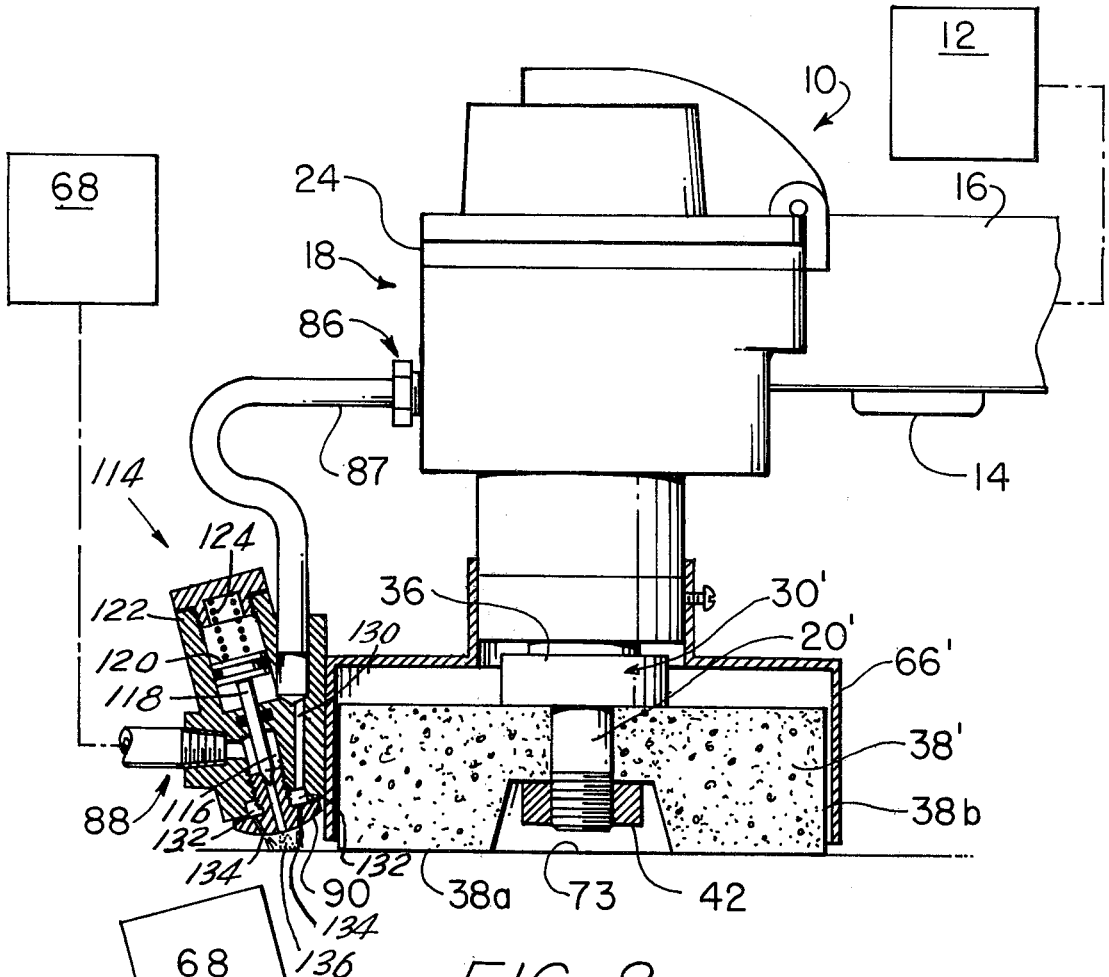

FIG. 1
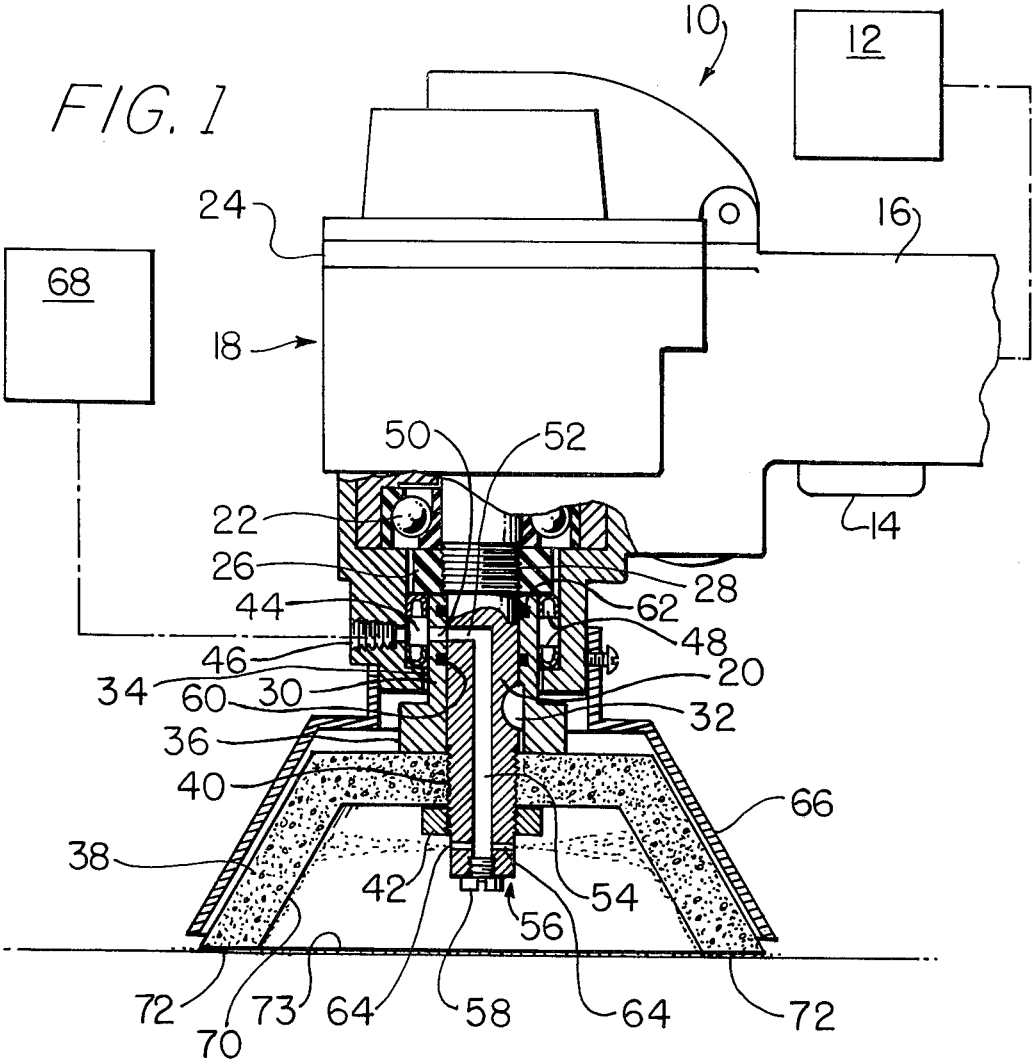
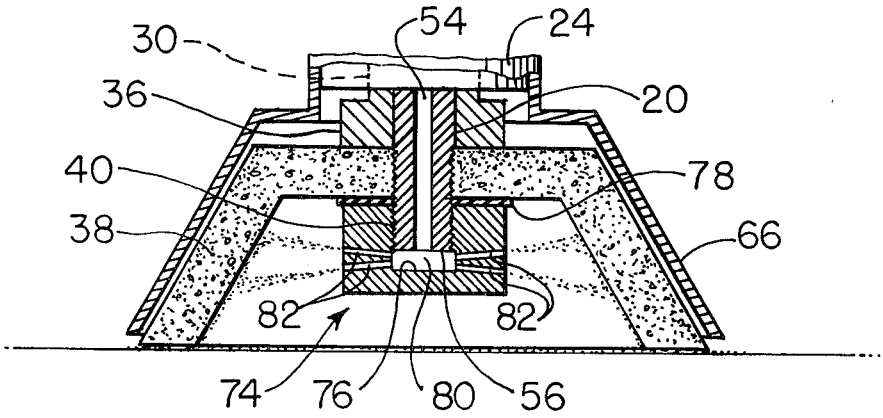
FIG. 1a

GRINDER APPARATUS WITH POLLUTION CONTROL FLUID DISPENSING MEANS

This invention relates to pollution control apparatus and particularly to devices for controlling the discharge into the air of particulate contaminants generated by grinding and finishing operations. Especially, this invention relates to such operations carried out by a worker with a hand-held grinding apparatus.

Many types of apparatus for dispensing fluids, particularly liquids, to grinding, polishing and other abrasive finishing apparatus are known. Examples of such apparatus are illustrated in the following U.S. Pat. Nos.: Grage, 3,110,993; Consigliere, 2,207,312; Rebechini, 3,099,905; Drummond, 2,733,562; and, Voorhies, 3,609,931. In all of these except the Grage patent, the fluid, generally a liquid, is distributed through a bore which extends longitudinally of the output shaft of a fluid or electric motor. The abrasive tool is attached to this output shaft. In the Grage patent, the fluid is dispensed into a reservoir provided on the back side of the abrasive attachment. The fluid is conveyed through the attachment to the abrasive surface thereof due to the porosity of the abrasive attachment.

In at least one of these patents, Rebechini, et al, the fluid dispensed is the abrasive material itself (a rubbing or polishing compound slurry which is being dispensed onto a buffing head). In the Voorhies, Drummond and Grage patents, the fluid is a liquid coolant, such as water. In the Consigliere patent, the fluid is a compressed air-oil vapor mixture. In Consigliere, the stated purpose for dispensing this mixture is to blow dusts generated during grinding out of a bore in which grinding is taking place. Only the Grage patent mentions another and highly desirable purpose for dispensing a fluid onto the grinding surface of a grinding or finishing apparatus, or onto a work piece upon which such grinding is taking place. That purpose is to control expulsion into the atmosphere of particulate matter generated during the grinding or finishing operation. Grage is particularly interested in the grinding or finishing of granite and other stone surfaces, and control of respirable micron and sub-micron size particulate contaminants, such as silica dusts which can be expelled into the atmosphere during such stone work.

It is an object of the present invention to provide a simpler, yet efficient apparatus for dispensing a pollution control fluid adjacent the grinding surface of a grinding apparatus. As used herein, the term "grinding apparatus" includes wheel- or disc-shaped grinding tools, cup-shaped grinding tools, and discs or sheets of sandpaper, since respirable particulate contaminants can be generated during the operation of any of such grinding or finishing tools.

According to the invention, a grinder includes an integral motor, means for connecting the motor to a power source, and grinding means actuated by the motor and including a grinding surface. Means are included for providing a stream of a pollution control fluid to the grinder. Additional means are provided for atmozing the stream of pollution control fluid and dispensing the pollution control fluid adjacent the grinding surface to capture particulate contaminants generated during the grinding operations.

In several illustrated embodiments, the atomizing means generates a fog of pollution control fluid particles, the fog directed toward the grinding surface to provide substantial contact between atomized pollution control fluid particles and airborne particulate contaminants.

In several of the illustrated embodiments, the motor includes an output shaft, the surface grinding means being coupled to the output shaft and the stream providing means includes first bore which extends longitudinally through the output shaft. In one of the illustrated embodiments, the first bore is provided concentrically within the shaft, and the atomizing means includes at least a second bore in the shaft. The second bore intersects the first and extends to the surface of the shaft. The stream of pollution control fluid is supplied through the first and second bores to the surface of the shaft and atomized there, partly by centrifugal force due to shaft rotation.

In one illustrated embodiment, the grinding means is connected to the end of the shaft by a threaded nut and cooperating threads at the end of the shaft remote from the motor. A first bore extends to the end of the shaft remote from the motor and the nut and shaft cooperatively define a chamber adjacent the remote end of the shaft. The atomizing means includes a second bore defined within the nut. The second bore extends from the chamber to the outside surface of the nut. The stream of pollution control fluid is supplied through the first bore to the chamber, and from the chamber through the second bore to the surface of the nut where it is atomized by centrifugal force due to rotation of the shaft and nut.

In an illustrated embodiment, the motor is a pneumatic motor. The atomizing means includes means for mixing the pollution control fluid with a dispensing gas to atomize the pollution control fluid. The dispensing gas for the pollution control fluid is first passed through the pneumatic motor at a first superatmospheric pressure to rotate the shaft. The dispensing gas is then exhausted from the motor at a second and substantially lower superatmospheric pressure.

Other embodiments are presented wherein the means for atomizing the pollution control fluid includes a nozzle located adjacent the grinding surface to atomize the fluid and direct the fog of atomized fluid toward the grinding surface.

In all of the illustrated embodiments, the grinder is a hand-held, portable grinder which can be handled by an individual operator.

The motor may be an electric, pneumatic or hydraulic motor. The grinding means may be a disc-shaped rotary grinding tool or wheel, a cup-shaped rotary grinding tool, a sanding disc or the like.

Figure 3:
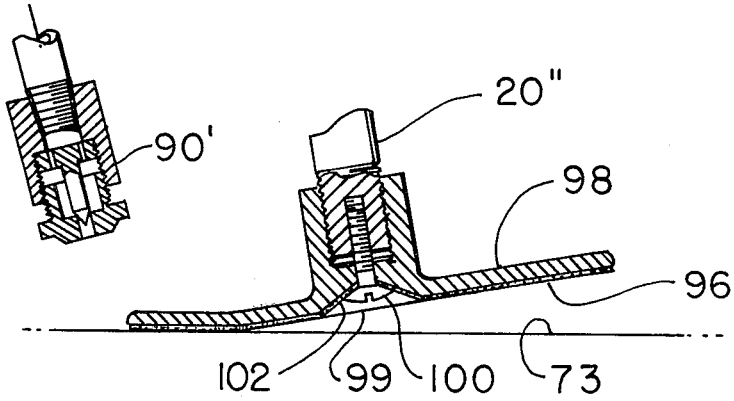

The invention may best be understood by referring to the following description and accompanying drawings which illustrate the invention. In the drawings:

FIG. 1 is a partly sectioned fragmentary side elevational view illustrating a hand-held grinder including an atomizing system constructed according to the present invention;

FIG. 1*a* is a partly sectioned fragmentary elevational view of an alternative embodiment of the grinder of FIG. 1;

FIG. 2 is a partly sectioned fragmentary side elevational view of another embodiment of the instant invention; and, FIG. 3 is a partly sectioned fragmentary side elevational view of another embodiment of the instant invention.

Turning now to FIG. 1, a hand-held grinder 10 is coupled to a source 12 of fluid under pressure, in this case compressed air. Source 12 is illustrated diagrammatically. A trigger 14, conveniently located on the grinder handle 16, controls a valve (not shown) located internally of grinder 10, which causes compressed air to flow from source 12 through an air motor 18. The air motor 18 is exhausted externally of the grinder 10 through an exhaust port (not shown). The air motor 18 includes an output shaft 20 suitably journalled in bearings 22. The housing 24 for air motor 18 extends beyond bearings 22 to house a retaining nut 26 which is threaded onto a threaded section 28 of shaft 20. The diameter of shaft 20 is reduced beyond threaded section 28 and a collar 30 is keyed by a key 32 to shaft 20. Collar 30 rotatably fits through an aperture 34 provided in the end of housing 24. Collar 30 includes an enlarged portion 36 which provides a backing flange for an abrasive grinding cup 38. Shaft 20 includes a threaded end portion 40, and a nut 42 is provided to attach cup 38 to shaft 20.

The end of housing 24 remote from air motor 18 provides an annular chamber 44 which surrounds a portion of the reduced section of shaft 20. An entry port 46 is provided in housing 24 in communication with chamber 44. Chamber 44 is sealed from bearings 22 and from aperture 34 by a pair of lip seals 48. Mating bores 50, 52 extend radially through collar 30 and to the axis of shaft 20, respectively. Bores 50, 52 are held in registry by key 32. A longitudinal bore 54 extends coaxially within shaft 20 from the distal end 56 thereof to intersect bore 52. The end of bore 54 is threaded and is plugged by a screw 58. Leakage from bore 50 longitudinally along shaft 20 between the shaft and collar 30 is prevented by O-rings 60 which are located in annular grooves 62 about the inside of collar 30. At least one, and preferably several, bores 64 extend from the surface of shaft 20 adjacent distal end 56 to intersect bore 54. Bores 64 desirably have a combined cross sectional area relatively less than the area of bore 54 so that pressure can be maintained in bore 54.

A guard or shield 66 is adjustably attached to the end of housing 24 to surround cup 38. As the cup wears, the guard 66 may be adjusted toward the motor 18 end of housing 24 so that the grinding surface of cup 38 is exposed.

In operation, a pollution control fluid, illustratively water, is supplied from a source 68, illustrated diagrammatically, through port 46. Source 68 can dispense the water with a compressed dispensing gas, such as air. The water fills annular chamber 44 and is supplied continuously through aligned bores 50, 52, into longitudinal bore 54 and through bore 54 to bores 64. When motor 18 is actuated, the centrifugal force exerted upon the streams of water emanating from bores 64 causes these streams to be finely divided or atomized at the surface of shaft 20 and distributed along the interior wall 70 of cup 38. Dispensing the water with compressed air aids in the atomization of the water. This atomized water provides a continuous flow downwardly and radially outwardly along interior walls 70. Additionally, some of this water penetrates the porous abrasive material from which grinding cup 38 is constructed. The combination of the continuous flow along interior wall 70 and the permeation of a portion of the water into the material of cup 38 provides a sufficient flow along the grinding surface 72 of cup 38 to entrain respirable and other particulates generated during grinding operations in a water slurry. This slurry can be left on the work piece surface 73 until the grinding operations are completed, or can be removed from surface 73 by suitable means (not shown) as grinding proceeds.

FIG. 1*a* illustrates an alternative configuration for the distal end 56 of shaft 20. In this embodiment, those elements numbered identically with the elements described in FIG. 1 perform the same or similar functions. In this embodiment, the distal end of bore 54 is not closed by screw 58. Rather, a special nut 74 is provided which performs the function of nut 42 andd bores 64 in the embodiment of FIG. 1. Nut 74 includes a blind bore 76 which may be threaded only for a portion of its depth. After the grinding cup 38 is placed on shaft 20, a spacer washer 78 is placed on the shaft and nut 74 is tightened on the shaft to attach cup 38 to the distal end of the shaft. A chamber 80 is thereby formed in blind bore 76 between the distal end 56 of the shaft and the bottom of bore 76. At least one, and preferably several intersecting bores 82 extend from chamber 80 to the radially outer surface 84 of nut 74. Chamber 80 and bores 82 provide communication between bore 54 and the inside of cup 38. This arrangement provides for a flow of atomized water from the source to the interior wall 70 of cup 38, and from there to the grinding surface 72. The total cross sectional area of bores 82 is relatively less than the cross sectional area of bore 54 to maintain pressure in chamber 80.

The flow of water from source 68 can be controlled by valve means (not shown) actuated simultaneously with trigger 14 to prevent leakage of water onto work piece 73 when air motor 18 is inactive.

Turning now to the embodiment of the invention illustrated in FIG. 2, those elements numbered identically with elements discussed in connection with FIGS. 1-1*a* perform the same or similar functions. In this embodiment, collar 30 is replaced by a collar 30′ which does not have a bore 50. Shaft 20 is replaced by a shaft 20′ which is solid. There is no chamber 44, nor any port 46. Collar 30′ includes an enlarged portion 36 against which a grinding wheel or disc 38′ is held tightly by a nut 42. The guard or shield 66′ for this embodiment is for a disc or wheel-type grinding tool rather than a cup.

In this embodiment, compressed air is first passed through air motor 18 from source 12 by actuation of trigger 14 at a first predetermined superatmospheric pressure. The air is then exhausted from air motor 18 through an exhaust port 86 and conduit 87 into a valve mechanism 88. This compressed air is exhausted into valve mechanism 88 at a second and substantially lower superatmospheric pressure, i.e., the exhaust pressure of motor 18. Water is supplied from source 68 to valve mechanism 88. A nozzle 90 extends from valve mechanism 88 to a position adjacent the grinding surface of wheel 38′. Since either the axially downwardly facing surface 38*a*, or the radially outwardly facing surface 38*b* of wheel 38′ can be the grinding surface, it is desirable to mount nozzle 90 sufficiently flexibly so that it can be positioned to direct a stream of atomized water onto either surface 38*b* or to a point adjacent surface 38*a* where the atomized stream will form a fog adjacent the work piece surface 73. The fog causes agglomeration of the particulates being generated by the grinding operation. The agglomerated particulates condense on the work piece surface 73 forming a slurry which can be removed at any time.

Valve mechanism 88 is of a type wherein air flow from exhaust port 86 controls the flow of water between source 68 and nozzle 90. Thus, when motor 18 is not running, no water will be dispensed. The compressed air which operates valve mechanism 88 is dispensed with the water through nozzle 90, atomizing the water.

In the embodiment of FIG. 2, the atomizing means includes the nozzle 90 coupled to the water source 68, and a valve 114 for controlling the flow of water to the nozzle 90 in response to the flow of air from the air motor 18 exhaust 86. The valve 114 comprises a passageway 116, a needle 118 sealingly and slidably engaged in the passageway 116, a piston 120 coupled to the needle 118, a cylinder 122 reciprocably receiving the piston 120, and means 124 yieldably urging the valve needle 118 to a closing position in the passageway 116. Air flow in the motor 18 exhaust 86 moves the piston 120 to slide the needle 118 from closing engagement in the passageway 116 to open the passageway 116 to permit the flow of water therefrom. The yieldable urging means 124 comprises a coil spring disposed in the cylinder 122 to urge the piston 120 to valve closing orientation. The nozzle 90 further includes passageways 130, 132, 134 for dispensing motor exhaust air in streams 136 with the water to aid in atomization of the water.

In another embodiment of the instant invention, illustrated in FIG. 3, atomization of water occurs at the nozzle 90'. Nozzle 90' is an adjustable spray nozzle, and atomization is effected by maintaining sufficient pressure from supply 68 to cause atomization. In this last embodiment, the grinding tool is a sanding disc 96 mounted on a flexible pad 98. Pad 98 generally is a rubber pad. Disc 96 is attached to rubber pad 98 by means of a screw 99. The head 100 of screw 99 fits into a relief 102 provided in backing pad 98. Head 100 attaches disc 96 to the shaft 20'' of a motor (not shown) which is generally an electric motor. Typically, shaft 20'' fits into a chuck formed at the end of the motor shaft. The atomizing nozzle 90' is preferred in electric motor applications, and frequently in hydraulic motor applications, because in such applications, compressed air may not be available.

What is claimed is:

1. A hand-held grinder comprising a housing, a pneumatic motor housed within the housing, handle means provided on the housing for holding the grinder, means for connecting the motor to a source of compressed gas, and grinding means driven by the motor, the grinding means being connected to an output shaft of the motor and including a grinding surface, a source of pollution control fluid, means for atomizing the pollution control fluid and for dispensing the pollution control fluid adjacent the grinding surface to capture particulate contaminants generated during grinding operations, means for coupling the atomizing means to the source of pollution control fluid, the motor including an exhaust port and means for coupling the exhaust port to the atomizing means, gas from the source being passed through the pneumatic motor at a first superatmospheric pressure to cause rotation of the shaft, then exhausted from the motor at a second, relatively lower superatmospheric pressure to control dispensing of the pollution control fluid in the atomizing means.

2. The apparatus of claim 1 wherein the atomizing means includes a nozzle coupled to the source of pollution control fluid, and a valve for controlling the flow of pollution control fluid to the nozzle in response to the flow of gas from the pneumatic motor exhaust.

3. The apparatus of claim 2 wherein the valve comprises a passageway, a needle sealingly and slidably engaged in the passageway, a piston coupled to the needle, a cylinder reciprocably receiving the piston, and means yieldably urging the valve needle to a closing position in the passageway, gas flow in the motor exhaust moving the piston to slide the needle from closing engagement in the passageway to open the passageway to permit the flow of pollution control fluid therefrom.

4. The apparatus of claim 3 wherein the yieldable urging means comprises a coil spring disposed in the cylinder to urge the piston to a valve closing orientation therein.

5. The apparatus of claim 3 wherein the nozzle further includes at least one passageway for dispensing a portion of the motor exhaust gas in a stream with the pollution control fluid to aid in atomization of the pollution control fluid.

* * * * *